US006192524B1

(12) United States Patent
Black

(10) Patent No.: US 6,192,524 B1
(45) Date of Patent: Feb. 27, 2001

(54) TOILET BOWL CLEANING AND SANITIZING COMPOSITION AND SYSTEM AND METHOD OF USING SAME

(75) Inventor: Robert H. Black, Jacksonville, FL (US)

(73) Assignee: Robert Black, Jacksonville, FL (US)

( * ) Notice: Subject to any disclaimer, the term of this patent is extended or adjusted under 35 U.S.C. 154(b) by 0 days.

(21) Appl. No.: 09/338,504

(22) Filed: Jun. 23, 1999

Related U.S. Application Data

(62) Division of application No. 09/065,414, filed on Apr. 24, 1998.
(60) Provisional application No. 60/044,566, filed on Apr. 24, 1997.

(51) Int. Cl.[7] ..... E03D 9/03
(52) U.S. Cl. ..... 4/225.1
(58) Field of Search ..... 4/225.1, 227.1

(56) References Cited

U.S. PATENT DOCUMENTS

| | | | | |
|---|---|---|---|---|
| 2,697,841 | * | 12/1954 | Collins | 4/225.1 |
| 4,020,016 | | 4/1977 | Sokol . | |
| 4,467,480 | * | 8/1984 | Keller | 4/225.1 |
| 4,821,346 | * | 4/1989 | Jones | 4/225.1 |
| 5,188,755 | | 2/1993 | Chang . | |
| 5,500,153 | | 3/1996 | Figueroa et al. . | |
| 5,510,049 | | 4/1996 | Connor et al. . | |
| 5,774,903 | * | 7/1998 | Wilson et al. | 4/227.1 |

* cited by examiner

*Primary Examiner*—Robert M. Fetsuga

(57) ABSTRACT

The invention relates to a solid cleaning and sanitizing composition and a solid surface erodable toilet bowl cleaning product containing the composition. The invention also relates to a device for holding the solid toilet bowl cleaning product in the overflow tube of a toilet and a method for keeping toilet bowls clean and sanitary.

19 Claims, 2 Drawing Sheets

TOILET BOWL CLEANING AND SANITIZING COMPOSITION AND SYSTEM AND METHOD OF USING SAME

CROSS-REFERENCE TO RELATED APPLICATIONS

This is a divisional application of Ser. No. 09/065,414, filed Apr. 24, 1998.

The present application claims priority under 35 U.S.C. §119(e) from U.S. provisional application No. 60/044,566, filed Apr. 24, 1997, the entire contents of which are hereby incorporated by reference.

BACKGROUND OF THE INVENTION

1. Field of the Invention

The present invention relates to a solid toilet bowl cleaning product having a surface erodable cleaning and sanitizing composition. The present invention also relates to a method of using the solid toilet bowl cleaning product by its placement in the overflow tube of a toilet and a toilet bowl cleaning and sanitizing system which includes a device for holding the solid toilet bowl cleaning and sanitizing product.

2. Description of the Related Art

The bowl and rim of toilets are traditionally cleaned either manually by periodically scrubbing with a solid or liquid cleaning agent or automatically after every flush by the use of commercially available tablets or blocks that are dropped into the tank or reservoir of the toilet. Manual scrubbing of the toilet bowl is inconvenient, unpleasant and sometimes messy, particularly if the toilet bowl has not been cleaned for an extended period of time.

While the commercially available drop-in tablets or blocks that are placed in the tank of the toilet act automatically after each flush, and thus are convenient for the consumer to use, these drop-in tablets or blocks have the drawback that their effectiveness is diminished by the manner in which standard toilets operate. The drop-in tablets or blocks placed in the tank release chemicals into the tank water to provide for the toilet bowl cleaning and/or antimicrobial/sanitizing action. When the toilet is flushed, tank water is released into the bowl, such as through port holes in the rim, and causes the level of water in the bowl to rise, which then starts a siphoning action that causes the water and materials in the bowl to be carried away through the trap and down the soil stack. The siphoning action stops when the tank water is fully discharged, and only the water remaining in the siphon is returned to the bowl.

As most of the tank water is flushed down the main drain, only a fraction of the treated tank water remains in the bowl to help in cleaning and sanitizing the toilet bowl. The effectiveness of this method is further reduced because the residues on the walls of the toilet bowl left by the discharging of the treated tank water into the bowl is not allowed to remain on the walls of the bowl, but is quickly rinsed off by the refill water. This refill water is provided directly into the overflow tube and out through port holes in the rim for distribution around the circumference of bowl.

Chang, U.S. Pat. No. 5,188,755, discloses such a surface erodable, controlled release tablet or block for cleaning a toilet bowl (lavatory) or urinal, and which is placed in the tank (cistern) of the toilet or urinal.

Systems which dispense cleaning chemicals and disinfectants dissolved from solids by the toilet bowl refill water entering the overflow tube are exemplified by U.S. Pat. No. 4,821,346 issued to Jones, and U.S. Pat. No. 2,697,841 issued to Collins. U.S. Pat. No. 4,821,346 discloses a toilet bowl cleaning composition dispenser which is placed in the overflow tube of a flush toilet and contains a solid cleaning composition. During the flush cycle of the toilet, the water entering the dispenser gradually dissolves the solid cleaner and dispenses a predetermined quantity of an active cleaning solution resulting from the dissolution of the solid cleaner into the toilet bowl.

U.S. Pat. No. 2,697,841 discloses a toilet disinfecting device which is installed in the overflow tube of a toilet and provided with granular chemicals. The disinfectant or other chemicals are supplied to the toilet bowl after each flushing or refilling operation. This patent to Collins is similar to U.S. Pat. No. 4,821,346 to Jones in that the refill water entering the overflow tube is first completely channeled through the dispenser or device which is disposed in the overflow tube and contains the solid chemicals, before being then supplied to the toilet bowl.

However, the size and position of these dispensers or devices in the overflow tube, occupying nearly the entire cross-section of the overflow tube, effectively eliminate the overflow tubes from acting to accommodate any potential overflow from the tank, such as from a malfunctioning float/valve assembly. Furthermore, there is no provision for maintaining a substantially constant erodable surface area for the solid cleaner composition, and the prior art compositions are considered ineffective for cleaning and sanitizing toilet bowls.

SUMMARY OF THE INVENTION

It is accordingly an object of the invention to overcome the deficiencies in the prior art, such as noted above.

The present invention provides an improved composition for effectively cleaning and sanitizing of toilet bowls and a solid product containing the composition which treats the water entering the overflow tube before it refills the toilet bowl. The toilet bowl cleaning and sanitizing product of the present invention is a surface erodable solid stick with a cross-section that enables the solid stick to maintain a substantially constant erodable surface area as the solid surface is eroded by the refill water entering the overflow tube.

The present invention also provides an improved device for holding the solid stick product in an operationally optimum position within the overflow tube of a toilet and as part of a toilet bowl cleaning and sanitizing system.

Further provided by the present invention is a method for keeping toilet bowls clean and sanitary by placing the solid stick product of the present invention in the overflow tube either as a self-supporting stick or in conjunction with a means or a device for holding the solid stick product.

DETAILED DESCRIPTION OF THE INVENTION

The solid toilet bowl cleaning and sanitizing product according to the present invention comprises an elongated element having a suitably shaped solid cleaning and sanitizing composition which is sufficiently erodable so as to release cleaning and sanitizing chemicals from its surface upon contact with a stream of water. This solid product is elongated in the manner of a stick and has the dimensions that allow the solid product to be placed in the overflow tube of a toilet without substantially interfering with the flow of water through the overflow tube.

Besides being elongated to fit inside the overflow tube, the solid toilet bowl cleaning and sanitizing product of the present invention also has a cross-sectional shape which enables the solid product to maintain a substantially constant surface area for releasing cleaning and sanitizing chemicals as the surface of the solid product is being eroded by toilet bowl refill water. While the erodable surface area of the solid toilet cleaning and sanitizing product is not maintained exactly constant, it is nevertheless maintained substantially constant. By the term "maintaining a substantially constant erodable surface area", it is meant that there is negligible change in the surface area of the solid as its surface is incrementally eroded between two successive flushes of the toilet.

The erodable surface area of the solid product is designed to be maintained substantially constant during use by appropriately selecting a cross-sectional shape where a portion of the solid whose surface area is decreased by erosion (represented by the changing outline of the corresponding portion in cross-section) is compensated or counteracted by another portion of the solid whose surface area is increased by erosion. In this manner, the surface area of the solid product as a whole is maintained substantially constant between flushes of the toilet while disposed in the overflow tube. Cross-sectional shapes which are suitable for maintaining a substantially constant erodable surface area can be readily determined based on the teachings herein, and then verified by calculation.

Figure 1:
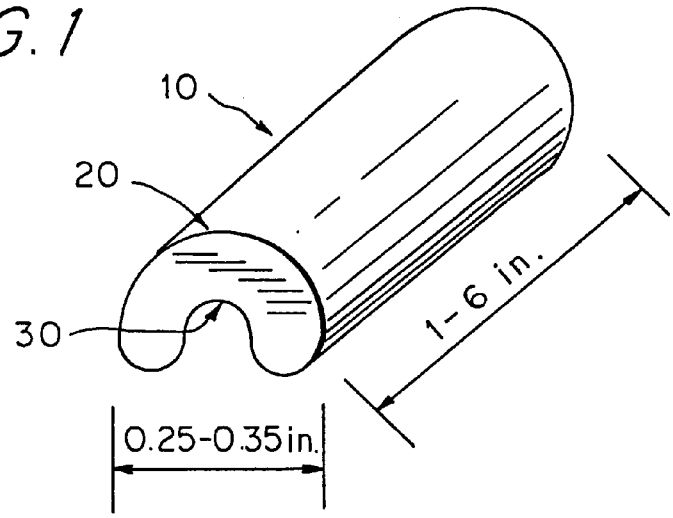
FIG. 1 shows a perspective view of one preferred embodiment of the solid stick toilet cleaning product of the present invention.

A non-limiting example of the shape of a stick of the solid toilet cleaning and sanitizing product is presented in FIG. 1. In this embodiment, the cross-sectional shape is C-shaped. FIG. 1 shows a solid stick 10 having a C-shaped cross-sectional area. As the surface of the solid stick 10 is eroded, the surface area on the outside of the C-shape represented by reference numeral 20 on the outline of the cross-section decreases, while at the same time the surface area on the inside of the C-shape represented by reference numeral 30 on the outline of the cross-section increases. Thus, a decrease in the surface area of one portion is counteracted or compensated by an increase in the surface area of a different portion.

FIG. 1 also indicates the preferred, but non-limiting, dimensions of the solid stick product of the present invention, where diameter/width is about 0.25–0.35 in. and the length is about 1 to 6 in. In general, while the cross-sectional area of the solid stick product is preferably in the range of about ⅛ to ½ the cross-sectional area of the overflow tube, it is more preferably in the range of about ¼ to ⅓ the cross-sectional area of the overflow tube.

Figure 2:
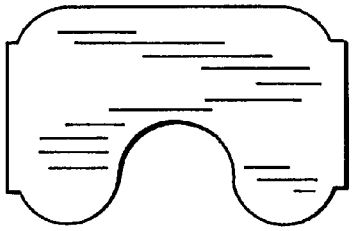
FIG. 2 shows an end view of a slightly modified version of the preferred embodiment of FIG. 1.
Figure 3:
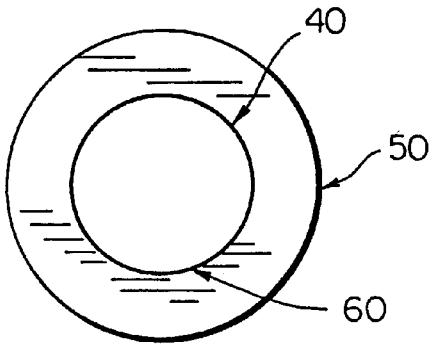
FIG. 3 shows an end view of a third embodiment of the solid stick toilet cleaning product of the present invention .

A C-shaped cross-sectional area, as shown in FIG. 2, is a modified version of the embodiment in FIG. 1 and is also a preferred embodiment. Another non-limiting example of the shape of the solid stick product is an elongated element with an annular cross-sectional area as shown in FIG. 3, where a decrease in surface area of the outer surface 50 of the annular ring 40 is counteracted or compensated by an increase in surface area of the inner surface 60.

The solid stick product of the present invention is formulated from a solid cleaning and sanitizing composition which include principal ingredients that have the primary properties/functions of (1) a chelating agent, (2) a surfactant, and (3) a dissolution rate controlling agent. Each principal ingredient may have more than one of the above properties or serve more than one function. For instance, an ingredient which is primarily a surfactant may also have dissolution rate-controlling properties, or an ingredient which is primarily a dissolution rate controlling agent may also have the property of a surfactant or chelating agent. Furthermore, the principal ingredients may also have additional desirable properties and can function as corrosion inhibitors, thickeners, antimicrobials, etc. Thus, some or all principal ingredients may serve one or more functions.

A preferred embodiment of the solid cleaning and sanitizing composition in percent by weight is as follows:

| | |
|---|---|
| ethylene diamine tetracetic acid | 58% |
| N-lauroyl,N,N',N'-ethylene diamine triacetic acid | 15% |
| polyoxyethoxylated $C_{16}$–$C_{20}$ alcohols (Rhodasurf TB-970 FLK) | 15% |
| polyethylene glycol (Polyglycol E8000) | 10% |
| FD&C Blue #2 | 2% |
| | 100% |

Generally, the ingredient preferably present in the largest amount in the solid cleaning and sanitizing composition is a chelating agent, which is preferably in the range of about 20 to 90% by weight, more preferably 35 to 70%, and most preferably 45 to 65%. While the chelating agent ethylene diamine tetracetic acid (EDTA) is preferred as the largest principal ingredient, as provided in the above preferred embodiment, other suitable chelating agents for inclusion in the solid composition can readily be determined by those of skill in the art. These may include diethylene triamine pentacetic acid (DTPA), nitrilotriacetic acid (NTA), hydroxylethyl ethylene diamine triacetic acid (HEEDTA), and salts thereof.

The preferred surfactant for cleaning the toilet howl advantageously provides a hydrophilic surface in the toilet bowl above the water line where a chelant-rich soluble film can be formed along with a chelant-rich area at and below the water line in the toilet bowl. When the surfactant is non-ionic, it has a sufficiently high hydrophilic-lipophilic balance number (HLB) to provide a hydrophilic surface above the water line in the toilet bowl. The HLB of non-ionic surfactants is preferably higher than 12, more preferably in the range of about 20 to 30.

The amount of surfactant in the solid toilet cleaning and sanitizing composition is preferably in the range of about 5 to 50% by weight, and more preferably 10 to 35%. Suitable surfactants include, but are not limited to, glycol ether ethoxylates of fatty alcohol, such as the polyoxyethylated $C_6$–$C_{20}$ alcohols commercially available from Rhome-Poulenc, Cranbury, N.J., as Rhodasurf TB-970 FLK, betaines, amphoterics, amine oxides, ethoxylated amines, block ethylene oxide and propylene oxide copolymers, and ethylene oxide and propylene oxide adducts to ethylene diamine.

The solid composition preferably has the property of sufficiently low dissolution in water so that the solid stick product is not quickly eroded away by water and is able to last about two to six weeks or in the range of about 400 to 500 flushes of the toilet. In addition, the solid composition preferably also has a melting point over 140° F. to avoid the problems associated with high temperature, such as may be encountered during shipping.

Controlling agents for controlling the rate of dissolution of the solid composition into water can be dissolution rate enhancers or dissolution rate reducers. Such control of the dissolution rate provides a balance between having a sufficient amount of the solid cleaning and sanitizing composition be dissolved/eroded away with each flush for effective cleaning action and minimizing the percentage of the solid product dissolved/eroded away to reduce the frequency of needing to replace the solid stick product.

Because the principal ingredients of a chelating agent and a surfactant, which provide the bulk of the solid composition, all have hydrophilic properties and would dissolve/erode more readily in the presence of water, it is important to have one or more compounds in the composition which act to slow down the dissolution of the solid composition. Dissolution rate reducers include N-acyl,N,N',N'-ethylene diamine triacetic acid, such as N-lauroyl,N,N',N'-ethylene diamine triacetic acid, commercially available from Hampshire Chemical Corporation, a subsidiary of Dow Chemical Co., Lexington, Mass., N-acyl sarcosines, carboxymethyl cellulose, carboxyethyl cellulose, and polyvinylpyrrolidone.

Advantageously, the dissolution rate reducers have other desirable properties. For instance, N-acyl,N,N',N'-ethylene diamine triacetic acids and N-acyl sarcosines have surfactant and corrosion-inhibiting properties. N-acyl,N,N',N'-ethylene diamine triacetic acids further provide some chelating properties, although not as strong or as effective as the principal chelating ingredient in the solid cleaning and sanitizing composition according to the present invention. Carboxymethyl cellulose, carboxyethyl cellulose, and polyvinyl pyrrolidone also advantageously function as thickeners.

Thus, N-acyl,N,N',N'-ethylene diamine triacetic acids and, in particular, N-lauroyl,N,N',N'-ethylene diamine triacetic acid, are especially preferred ingredients in the solid cleaning and sanitizing composition according to the present invention because they are so versatile and multifunctional, serving as dissolution rate reducer, surfactant, chelant, and corrosion inhibitor, in addition to acting as a binder to hold together the composition in a solid stick product and to prevent the composition from turning gooey.

As dissolution controlling agents, dissolution rate reducers are preferably present in the solid cleaning and sanitizing composition in the range of about 2 to 40%, and more preferably 10 to 30%. While the presence of dissolution rate enhancers, which include polyglycol ethers such as polyethylene glycol with a molecular weight of approximately 8000, commercially available from Dow Chemical Company under the name Polyglycol E8000, and block ethylene oxide and propylene oxide copolymers, are generally not required because of the hydrophilic nature of the principal chelant and surfactant ingredients, it may be sometimes desirable to provide them in the solid composition to fine-tune the control of the dissolution rate.

While optional, it is advantageous that a compound(s) which has corrosion-inhibiting and/or rubber-preserving properties be included in the solid toilet bowl cleaning and sanitizing composition. Preferred compounds having such properties are myristoyl sarcosine and N-lauroyl-N,N',N'-ethylene diamine triacetic acid, both of which function primarily as dissolution rate controlling agents but which also have desirable and advantageous secondary properties, namely as surfactants, chelants (N-lauroyl-N,N',N'-ethylene diamine triacetic acid only) and corrosion inhibitors.

A water-soluble dye in the range of about 0.2 to 15%, preferably in the range of about 1 to 5%, may be optionally added as a transient indicator of the release of cleaning and sanitizing ingredients into the toilet bowl after each flush. As a preferred example of a suitable dye, FD&C Blue #2 turns the water in the toilet bowl blue upon release from the solid stick product after each flush. However, the blue color is transient and turns clear in the presence of chlorine in chlorinated water or in the presence of an oxygenating agent, such as sodium perborate. By the transient nature of the color, the consumer is assured by visual inspection that a proper amount of cleaning and sanitizing ingredients are immediately released after each flush for effective cleaning and sanitizing action.

A short time after each flush, the color disappears to serve as an additional indicator that everything is working properly and to further provide the pleasing appearance of clear clean water as commonly accepted by the consumer. When there is little or no transient color after each flush, this is an indication that more solid stick product is needed. It will be appreciated that other suitable dyes in which the color disappears in the presence of chlorine or in the presence of an added agent, such as an oxygenating agent (i.e., oxygen-sensitive dyes), are well known to those in the art.

When chlorine is not present or added to a water system, such as in the case of many well water systems, an oxygenating agent, such as sodium perborate, is needed to make the blue color of FD&C Blue #2 in the water disappear and turn clear. A sufficient amount of an oxygenating agent, as can be readily determined by those of skill in the art, can be formulated into the solid cleaning and sanitizing composition. As will also be appreciated by those in the art, the FD&C Blue #2 dye and the oxygenating agent are preferably kept separate in the solid composition, and one method for doing so is to formulate the oxygenating agent and the FD&C Blue #2 separately before blending/mixing into the final solid composition. Otherwise, the dye may be less effective as an indicator, i.e., it may provide only a weak and rapidly disappearing color. For instance, the oxygenating agent can be blended first with a surfactant so that the oxygenating agent and the dye are less likely to be in contact after formulation into the final solid stick product.

Methods for encapsulation and formulation to keep two compounds from interacting/reacting are generally well known. The transient blue color indicator system of denture cleaning tablets commercialized under the name EFFERDENT and its formulation is but one example.

Alternatively, an optional water soluble dye may instead be added to provide a pleasing color to the toilet water and to signal the need for replacement of the solid toilet bowl cleaning and sanitizing product. The dye may be uniformly distributed in the solid composition, where the absence of color or the presence of only a weak tinge of color in the toilet bowl water is indicative of the solid stick is product being exhausted and in need of replacement. As another embodiment, the dye can be incorporated only at the center of the stick during manufacturing so that the dye is not exposed at the surface of the solid stick product until the stick is sufficiently eroded and in need of replacement.

To deter pets from drinking the water in the toilet bowl, even though the cleaning and sanitizing chemicals dispersed therein are safe with very low toxicity, a chemical that is repellent to pets, such as a bittering agent (denatonium benzoate, commercially available as BITREX), may be optionally added. Furthermore, viscosity builders or thickeners, antimicrobial agents, such as dimethylol dimethylhydantoin, inorganic salts, organic acid, and odor agents/fragrance may be optionally added to the solid toilet bowl cleaning and sanitizing composition. When present, an odor agent(s)/fragrance is present in a range of about 0.1 to 40% by weight, more preferably in a range of about 1 to 5%. A number of chelating agents, surfactants, inorganic salts and organic acids also have antimicrobial properties which can be used in place of or in combination with known antimicrobial agents such as dimethylol dimethylhydantoin.

The method for keeping toilet bowls clean and sanitary in accordance with the present invention involves placing the solid toilet bowl cleaning and sanitizing product of the present invention in the overflow tube of a toilet. The solid stick product of the present invention may be suitably disposed in the overflow tube in association with a holding means, such as a basket device or suspended from a hook, etc., or simply dropped into the overflow tube as a self-supporting stick. It will be appreciated by those in the art that whatever the method or means used to place the solid toilet cleaning and sanitizing product in the overflow tube, the flow of water in the overflow tube is not substantially restricted or interrupted. In conjunction with a holding means such as a hook, the solid stick product of the present invention may be manufactured with a fibrous material, i.e., string, as in the wick of a candle, etc., integrally incorporated into the solid stick at its center and along its longitudinal axis to extend beyond one end of the solid stick so that the solid stick product can be suspended from the hook holding means.

It is preferred, however, that the solid toilet bowl cleaning and sanitizing product be placed in a container device for holding the solid product in an overflow tube of a toilet. This container device positions the solid stick product directly in the path of toilet bowl refill water entering the overflow tube so that the solid composition is gradually eroded by toilet bowl refill water after each flush.

The container device according to the present invention includes a container for holding the solid stick product which is elongated to fit inside the overflow tube of a toilet and has multiple openings to allow water to pass through. It is well appreciated by those of skill in the art that the size of the container device is such that it does not block the overflow tube, i.e., does not prevent the overflow tube from serving its purpose of carrying away water from the reservoir tank in the event of an overflow. Preferably, the container device also includes a means for holding the elongated container portion of the device substantially centered in the overflow tube so as to be more certainly positioned in the path of the entering toilet bowl refill water. The term "substantially centered" is meant to indicates a position in which the longitudinal axis of the elongated container is located in the middle third of the overflow tube diameter.

The means for holding the elongated container preferably includes a hook for hanging the container device on the lip of a toilet overflow tube and an extending portion which joins the hook and the elongated container portion. The extending portion, which is preferably angled, positions the elongated container sufficiently below the lip of the overflow tube so that the top open end of the elongated container is located in the path of the toilet refill water. The substantially centered positioning of the elongated container in the overflow tube depends on the slope and length of the extending portion, as well as any other element(s) of the container device which help to substantially center the elongated container. For instance, the means for centering also preferably includes one or more projections which extend from the container in a direction opposite to the direction imparted by the slope of the extending portion, and which thus serve to contact the walls of the overflow tube to substantially center the elongated container. When a projection is disposed at the open top end of the elongated container, such a projection preferably also serves to deflect the toilet refill water into the elongated container. Non-limiting examples of such projections include fins, fan-like projections, loops, etc. The hook and the extending portion alone or in combination with a projection are sufficient to prevent the device from accidently dropping to the bottom of the overflow tube. In other words, the device is designed so that the hook cannot fit completely inside the overflow tube.

A further preferred feature of the container device of the present invention is that the device is partly or completely made from a semi-flexible material, such as polyethylene or similar semi-flexible plastic materials. This flexibility allows the device to be inserted into the overflow tube even through a constriction created by, for example, the holder for the toilet water fill tube, where some force, wiggling and/or other manipulation may be needed to allow the elongated container to pass through the constriction.

Figure 4A:
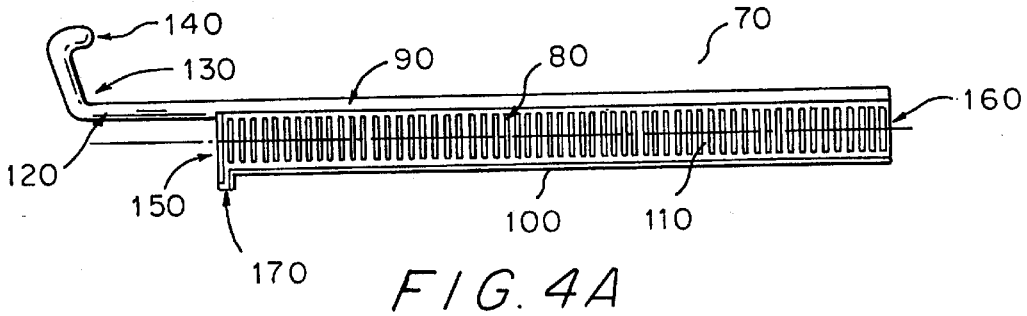
FIGS. 4A–4C show a side view (FIG. 4A), a front view (FIG. 4B), and a top view (FIG. 4C) of an embodiment of the device for holding the solid stick of the toilet cleaning and sanitizing composition according to the present invention.
Figure 4B:
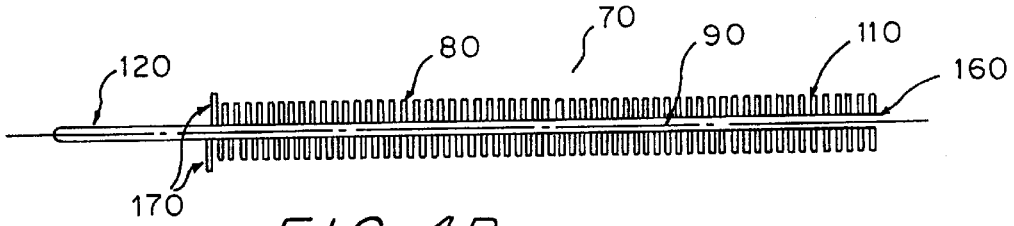
Figure 4C:
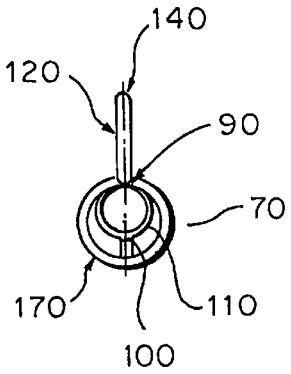

FIGS. 4A–4C illustrate a preferred embodiment of the container device according to the present invention which has the appearance of a elongated basket. The elongated cylindrical container (basket) 80 of the container device 70 is constructed from a longitudinally disposed spine member 90, sternum member 100 disposed parallel and diametrically opposite to the spine member, and multiple rib members 110 attached to the spine and sternum members where the rib members are staggered on opposite sides of the spine and sternum members. The cylindrical container 80 has an open top end 150 and a bottom end 160. While the bottom end 160 is closed in order to hold the solid product in the cylindrical container, it is preferred that the bottom end 160 has multiple openings or perforations to allow water to thoroughly drain away from the container between flushes.

An extending member 120, which is an extension of the spine member 90 with a bend 130, joins the free hooked end 140 to the cylindrical container 80. The free hooked end 140 and the extending member 120 lie in the plane formed by the spine 90 and sternum 100 members with the free hook end angled away from the cylindrical container 80 by bend 130. When positioned in the overflow tube of a toilet (FIG. 5), the free hooked end 140 and the angled extending member 120 hooks onto the lip of the overflow tube 180 and substantially centers the cylindrical container 80 in the overflow tube.

Figure 5:
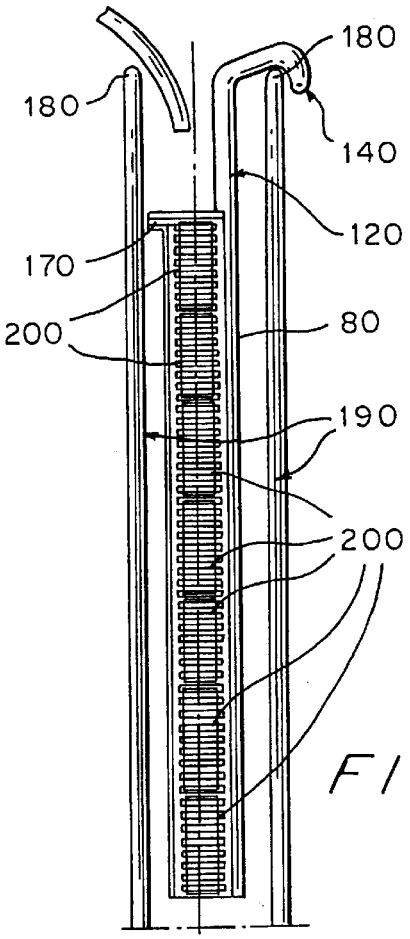
FIG. 5 shows a cross-section of a toilet overflow tube with the preferred embodiment shown in FIGS. 4A–4C positioned therein.

In FIGS. 4A–4C there is shown a projection 170, which is a loop having a diameter greater than the cylindrical container, disposed at the open top end 150 of the cylindrical container and attached to the spine and sternum members. This projection 170 acts in conjunction with the free hooked end and the angled extending member to help substantially center the cylindrical container in the overflow tube of a toilet (FIG. 5) by being disposed against the wall of the overflow tube opposite from the free hooked end. Moreover, the projection 170 not only helps substantially center and stabilize the position of the cylindrical container, it also serves to deflect or divert the toilet bowl refill water into the cylindrical container so that the refill water contacts the solid stick product 200 to erode and carry away an amount of the cleaning and sanitizing composition into the toilet bowl. As shown in FIG. 5, the cylindrical container preferably contains multiple units of the solid stick product 200.

The preferred embodiment of the device as shown in FIGS. 4A–4B is preferably fabricated from polyethylene using a two-piece mold. Each piece of the mold forms one half of the device divided along the plane created by the spine and sternum members. When both pieces of the mold are appropriately positioned, with the channels corresponding to the rib members staggered between the two pieces of the mold, the device shown in FIGS. 4A–4B can be formed without the need for a third core piece.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A device for holding a solid toilet bowl cleaning and sanitizing product in an overflow tube of a toilet, comprising:

an elongated container having a longitudinal axis and, along said longitudinal axis, an open top end for placing a solid toilet bowl cleaning and sanitizing product into said container and a bottom end, wherein said elongated container includes multiple openings to allow water to pass through and said solid toilet bowl cleaning and sanitizing product comprises a solid elongated element having a longitudinal axis, two ends, and an erodable surface having a cross-sectional shape and a surface area, whereby said cross-sectional shape allows said erodable surface to maintain a substantially constant surface area as said erodable surface is eroded; and a means for holding said elongated container substantially centered in the overflow tube of a toilet to be in the path of toilet bowl refill water.

2. The device according to claim 1, wherein said means for holding said elongated container substantially centered in the overflow tube of a toilet comprises an overflow tube lip hook, disposed above and attached at one end to said elongated container, wherein said hook comprises a free end bent downward to hook onto the top lip of a toilet overflow tube and a downwardly sloped extending portion for positioning said open top end of said elongated container sufficiently below the lip of the overflow tube to be in a path of toilet bowl refill water.

3. The device according to claim 2, wherein said means for holding further comprises a projection from said elongated container.

4. The device according to claim 3, wherein said projection comprises means to deflect the toilet bowl refill water into said container.

5. The device according to claim 4, wherein said projection is a fin.

6. The device according to claim 4, wherein said projection is a loop.

7. The device according to claim 3, wherein said elongated container is cylindrical.

8. The device according to claim 7, wherein said projection comprises a circular loop attached to said open top end of said cylindrical container, wherein said circular loop has a diameter greater than the diameter of said cylindrical container to help substantially center said cylindrical container and to deflect the toilet bowl refill water into said cylindrical container.

9. The device according to claim 7, wherein said cylindrical container comprises a longitudinally disposed spine member and rib members attached to said spine member.

10. The device according to claim 9, wherein said cylindrical container further comprises a sternum member parallel to the spine member.

11. The device according the claim 10, wherein said sternum member is diametrically opposite to said spine member, and wherein said rib members are staggered on opposite sides of said spine member.

12. The device according to claim 1, wherein said elongated container is semi-flexible.

13. The device according to claim 1, wherein said elongated container is made from a plastic material.

14. The device according to claim 13, wherein said plastic material is polyethylene.

15. The device according to claim 1, wherein said means for holding positions said elongated container below a toilet water fill tube.

16. The device according to claim 1, wherein said means for holding prevents the device from being capable of falling to the bottom of the toilet overflow tube.

17. A mold, consisting of two pieces, each piece serving as a mold for one half of the device of claim 11, wherein the halves of the device are divided by a plane formed by said spine member and said sternum member.

18. The method for keeping toilet bowls clean and sanitary, comprising the step of placing a solid toilet bowl cleaning and sanitizing product in the device of claim 1, wherein the solid product comprises a solid elongated element having a longitudinal axis, two ends, and an erodable surface having a cross-sectional shape and a surface area, whereby said cross-sectional shape allows said erodable surface to maintain a substantially constant surface area as said erodable surface is eroded.

19. A system for discharging a composition into a toilet bowl, comprising:

a solid composition formed into a stick; and a device for holding the solid stick substantially centered in the overflow tube of a toilet and in the path of toilet bowl refill water according to claim 1, wherein a composition which is eroded from the surface of the solid stick by toilet bowl refill water, is mixed with the toilet bowl refill water for discharge into a toilet bowl.

* * * * *